United States Patent [19]

Fukushima et al.

[11] 4,175,416

[45] Nov. 27, 1979

[54] APPARATUS FOR MANUFACTURING HEAT TRANSFER TUBES

[75] Inventors: Toshihiko Fukushima, Shimoinayoshi; Kunio Fujie, Tokyo; Akira Arai, Sakuramura; Nobukatsu Arai, Ushikumachi; Kimio Kakizaki, Hitachi, all of Japan

[73] Assignee: Hitachi, Ltd., Japan

[21] Appl. No.: 868,664

[22] Filed: Jan. 11, 1978

[30] Foreign Application Priority Data

Jan. 18, 1977 [JP] Japan ..... 52-3644

[51] Int. Cl.[2] ..... B21C 23/10; B21C 25/04; B21C 1/34; B21C 3/00

[52] U.S. Cl. ..... 72/254; 72/256; 72/264; 72/275; 72/278; 72/283; 29/157.3 A; 113/118 V; 425/325

[58] Field of Search ..... 72/253, 254, 256, 264, 72/265, 266, 275, 283, 370; 29/157.3 A; 113/118 A, 118 R, 118 V; 425/325; 29/157.3 AH

[56] References Cited

U.S. PATENT DOCUMENTS

| | | | |
|---|---|---|---|
| 2,586,011 | 2/1952 | Doelter | 29/157.3 AH |
| 3,289,451 | 12/1966 | Koch et al. | 72/283 |
| 3,422,518 | 1/1969 | French | 29/157.3 A |
| 3,662,582 | 5/1972 | French | 29/157.3 A |
| 3,750,709 | 8/1973 | French | 29/157.3 A |
| 3,776,018 | 12/1973 | French | 29/157.3 A |
| 3,887,004 | 6/1975 | Beck | 29/157.3 A |
| 4,031,279 | 6/1977 | Cremer | 428/116 |
| 4,060,125 | 11/1977 | Fujie et al. | 29/157.3 R |

FOREIGN PATENT DOCUMENTS

| | | | |
|---|---|---|---|
| 31863 | of 1964 | Japan | 72/283 |
| 408354 | 9/1966 | Switzerland | 72/266 |
| 1202491 | 8/1970 | United Kingdom | 72/283 |
| 489544 | 1/1976 | U.S.S.R. | 72/265 |

*Primary Examiner*—Francis S. Husar
*Assistant Examiner*—D. M. Gurley
*Attorney, Agent, or Firm*—Craig and Antonelli

[57] ABSTRACT

An apparatus for manufacturing heat transfer tubes for use in evaporators and coolers for freezers, air conditioning units, refrigerators, and the like, with close machining tolerances. It forms cavities, with small openings communicating them with the outside, on the inside of a tube, through three steps of forming a multiplicity of alternate grooves and ribs in parallel on the inner surface of the tube, forming cuts in the concentrically directed crests of the ribs, and then forcing the crests sidewise so that the crest of each rib is bent down onto an intermediate part of the adjacent rib to form a cavity in between.

19 Claims, 7 Drawing Figures

APPARATUS FOR MANUFACTURING HEAT TRANSFER TUBES

LIST OF PRIOR ART REFERENCES (37 CFR 1.56(a))

The following references are cited to show the state of art:

Japanese Pat. Publication No. 31863/1974

U.S. Pat. application No. 586,930 Specification now U.S. Pat. No. 4,060,125.

BACKGROUND OF THE INVENTION

1. Field of the Invention

This invention relates to an apparatus for manufacturing heat transfer tubes for use in evaporators and coolers of freezers, air conditioning units, refrigerators, and the like.

2. Description of the Prior Art

Among the prior inventions, one closely concerned with this invention is disclosed in the specification of Japanese Patent Publication No. 31863/74.

The specification describes a method of forming numerous rhombic or rhomboidal protuberances in a regularly spaced pattern on the inner surface of a pipe by first inserting a plug having a number of helical edges on the outer surface into a pipe with a smooth inner surface to form helical ribs and grooves thereon, and then inserting another plug having a number of helical grooves of a lead angle different from that of the first plug into the same pipe to cut and partially remove the previously formed helical ribs at regular intervals.

According to the method, the first step of operation for forming the helical grooves and the second step for partially removing the resulting helical ribs are separate and independent of each other. In the second stage the relative positions of the plug and pipe tend to be instable, resulting in dimensionally ununiform removal of the ribs. For this reason, the technique taught by the Japanese Pat. Publication No. 31863/74 cannot be resorted to where the relative positions of the plugs in the first and second steps are to be consistent.

The heat transfer surface structure to be provided in accordance with the present invention for the interior of a heat transfer tube is generally the same as the structure revealed in our copending U.S. Pat. application Ser. No. 586,930.

SUMMARY OF THE INVENTION

It is an object of the present invention to provide an apparatus for forming a heat transfer surface with cavities and openings by which the cavities are communicated with the outside, that is, a heating surface equivalent to the heat transfer wall disclosed in U.S. Pat. application Ser. No. 586,930, on the inside of tubes.

Another object of the invention is to provide an apparatus for manufacturing heat transfer tubes with an inner heating surface uniform in quality.

DETAILED DESCRIPTION OF THE INVENTION

Figure 1:
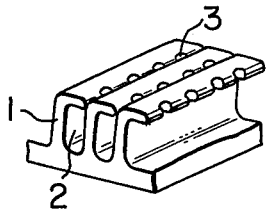
FIG. 1 is a fragmentary perspective view of a typical heat transfer surface to be formed on the inside of a heat transfer tube.

FIG. 1 shows in perspective a typical heat transfer surface to be made by the apparatus of the invention. As shown, the surface includes a number of ribs 1 formed substantially in parallel, with the crest of each rib bent down into contact with the adjacent rib, a number of cavities formed between, and separated from one another by, those ribs, and a number of tiny openings 3 made at regular intervals in the crests of the ribs and along the respective cavities so as to communicate those cavities with the outside.

This heat transfer surface is for boiling use, and a factor having a major bearing upon its boiling characteristics is the size of the openings 3. Where Freon (R-12, R-22, R-502, or the like) is to be employed as the boiling medium, an opening size such that the diameter of a circle inscribed in the average opening 3 is between approximately 0.1 and 0.2 mm gives a good result. Then, the pitch between the cavities 2 ranges from 0.2 to 1.0 mm, and the pitch between the openings 3 ranges from 0.2 to 1.0 mm. The cavities 2 are from 0.2 to 0.8 mm in depth and from 0.1 to 0.8 mm in width. The ratio of the wall thickness of the ribs 1 to the width of the cavities 2 is 1:2.

Figure 2:
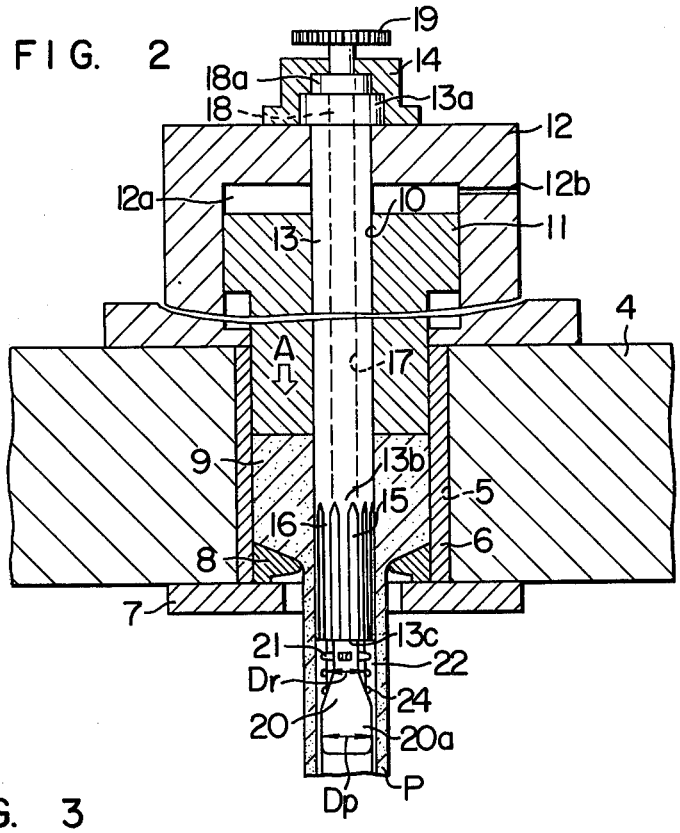
FIG. 2 is a sectional view of an apparatus embodying the invention.

FIG. 2 illustrates in section an apparatus embodying the invention for forming the heat transfer surface depicted in FIG. 1 as the inner wall of a tube. All parts are shown in section except for the mandrels to be described later. The apparatus is designed to form the heat transfer surface of FIG. 1 on the inside of a tube while extruding a billet into the tube form.

A container 4 has a cylindrical hollow or chamber 5, and a liner 6 is tightly fitted on the surrounding wall of the chamber. At the lower end of the chamber 5 is secured a die 8 by means of a die holder 7. The chamber 5 contains a billet 9 of copper, aluminum, or the like. In the chamber 5 is placed a hollow ram 11 having an outside diameter slightly smaller than the inside diameter of the liner 6 and formed with a bore 10 coaxial with the ram body. This ram 11 is contained in a cylinder 12 fixed to the container 4 by bolts. A mandrel 13 slightly smaller in diameter than the bore 10 is inserted in the bore. With its head **13*a* secured to the cylinder 12 by a retaining cap 14, the mandrel 13 is kept from moving axially. The lower portion of the mandrel 13 facing the die 8, from a point 13*b* down to the lower end 13*c*, has straight grooves 15 and edges 16 formed axially in parallel. The mandrel 13 has its own bore 17 coaxial with the body, and another mandrel 18 is inserted in this bore. The head 18*a* of the mandrel 18 is disposed between the head of the mandrel 13 and the retaining cap 14, and the mandrel 18 is rotatable but unable to move axially. A gear 19 is mounted on top of the mandrel 18, so that power from a motor (not shown) can be transmitted through the gear 19 to the mandrel 18 for its rotation. The lower end portion of the mandrel 18 extends downward from the lower end 13c of the mandrel 13 and is tapered, constituting a taper plug 20 for forcing sidewise the crests of ribs formed on the inside of a tube P. The diameter Dp of the largest diameter portion 20a of the taper plug 20 is greater than the diameter Dr of the circle connecting the crests of ribs formed in the tube P. The mandrel 18 has at least one cutting blade 21 attached to its portion between the taper plug 20 and the lower end 13c of the mandrel 13. The edge of the cutting blade 21 is adjusted in height, depending on the desired size of the openings 3 to be formed in the heat transfer surface as illustrated in FIG. 1**.

The operation of the embodiment will be described below.

Figure 3:
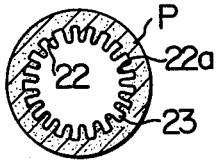
FIG. 3 is a cross sectional view of a tube immediately after initial machining, with grooves and ribs formed on the inside.

Hydraulic fluid under pressure is supplied to the space 12 above the ram 11 in the cylinder 12 to force the ram downward (forward) in the direction of the arrow A, while, at the same time, the mandrel 18 is driven for rotation. With the advance of the ram 11, the billet 9 is continuously extruded through the annular space between the die 8 and the mandrel 13 into the form of a tube P. Simultaneously with the extrusion, the tube P is formed with straight ribs 22 and grooves 23 on its inner surface which inversely correspond to the grooves 15 and ridges 16 of the mandrel 13. The cross sectional contour of the tube P worked in this way is shown in FIG. 3.

Because the cutting blade 21 revolves with the mandrel 18, it cuts the inner surface of the tube P being continuously fabricated by extrusion, thereby forming cuts 24 in the ribs 22 on the inside. The tube portion with the ribs 22 and cuts 24 then comes down into sliding contact with the taper plug 20, where the crests 22a of the ribs directed toward the center of the tube P begin to be forced sidewise by the taper plug 20, in succession, toward the adjacent ribs in the rotating direction of the plug. As the diameter of the taper plug 20 increases, the crests 22a of the ribs 22 draw closer to the adjacent ribs until they are pressed against and bent permanently onto intermediate parts of the adjacent ribs. The crests 22a of the ribs 22 so bent down close the open tops of the grooves 23, forming the cavities 2 of the heat transfer surface shown in FIG. 1, the cuts 24 of each rib in permanent contact with the adjacent rib serving as the openings 3.

Figure 4:
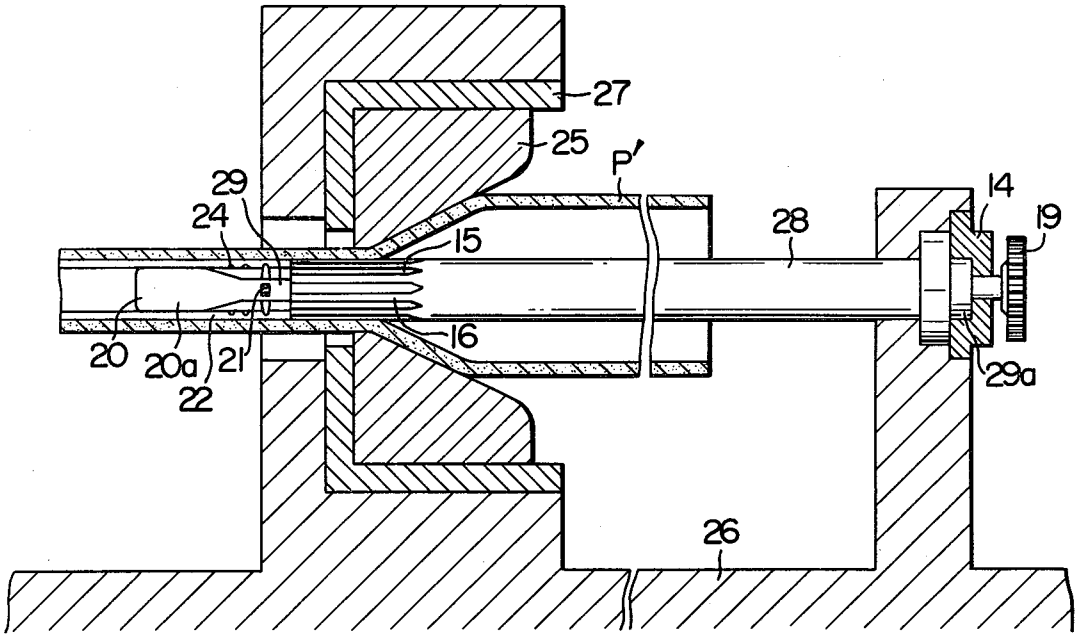
FIG. 4 is a sectional view of another embodiment of the invention.

Another embodiment of the invention shown in secton in FIG. 4 uses a preformed pipe as the material for producing a heat transfer tube. While drawing the pipe to a smaller outside diameter, the apparatus forms on the inside of the work a heat transfer surface of the structure as described above with reference to FIG. 1.

In order to draw the material pipe P' and reduce its outside diameter, a drawing die 25 is employed. The die 25 is mounted in a die holder 27, which in turn is fast on a common base 26.

In this embodiment a mandrel 28 to form ribs 22 and grooves 23 on the inside of the work (as shown in FIG. 3) is of exactly the same construction as the mandrel 13 of the first embodiment already described. Another mandrel 29 to be used in forming cuts 24 in the ribs 22 (FIG. 3) is also identical in construction with the mandrel 18 of the preceding embodiment. The mandrel 28 is supported at its right end by the common base 26, and the mandrel 29 is kept axially unmovably, because a disk 29a it has at the right end is held between the extremity of the mandrel 28 and an end retainer 14. The mandrel 29 is rotatable instead, and it is driven by a motor (not shown) through a gear 19 fixedly mounted on its right end. This means for imparting the force to draw the pipe body is of a well-known structure, and the description is omitted.

The operation of this embodiment is the same as that of the first embodiment, except that the material pipe P' is drawn through the drawing die 25 to a reduced outside diameter.

Figure 5:
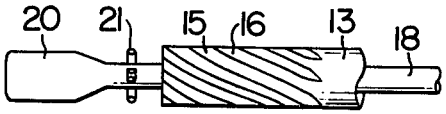
FIG. 5 is a front view of another form of mandrel for use in the apparatus of the invention.

Two embodiments of the invention have so far been described in which the mandrel 13 or 28 to form the ribs and grooves on the inner wall surface of a tube for heat transfer has alternate grooves and ridges for that purpose formed in parallel with its axis. Alternatively, the mandrel may have, as in FIG. 5, helical grooves 15 and ridges 16 at a given angle to the axis. In the latter case the mandrel 13 or 28 must be mounted rotatably with respect to the cylinder or the common base.

Figure 6:
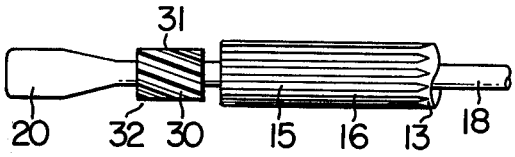
FIG. 6 is a front view of still another form of mandrel.

Also, while the embodiments have been described as using a cutting blade for forming cuts in the ribs, the blade may be replaced by a plug 32 as shown in FIG. 6 which has grooves 30 and ridges 31 both at a given angle to the grooves 15 and ridges 16 of the mandrel 13 or 28. In this modification the extrusion or drawing of the tube past the die and the mandrel 13 or 28 causes relative rotation of the plug 32, and there is no need of forcibly rotating the mandrel 18 or 29; the mandrel has only to be rotatably supported by the cylinder or common base.

Figure 7:
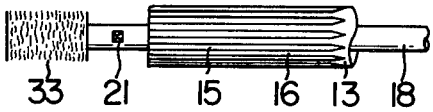
FIG. 7 is a front view of yet another form of mandrel.

Further, in bending the crests of the ribs sidewise to the intermediate parts of the adjacent ribs successively to close the open tops of the grooves with the bent crests, a wire brush 33 as shown in FIG. 7 may be used in place of the taper plug 20 already described. In that case the wire brush must be rotated at a higher speed than the taper plug. If necessary, a separate mandrel carrying the brush at its end may be employed. The wire brush, in sweeping down the crests of ribs into contact with the adjacent ribs, develops heat of friction. This heat facilitates deformation of the crests, allowing them to bend down and partly fuse into the adjacent ribs.

As described above, the apparatus of the invention can maintain close tolerances in machining the inside of tubing to form cuts, because the mandrel for forming ribs and grooves on the inner wall surface of a tube supports the other mandrel that carries a cutting blade or plug for forming cuts into the ribs and restricts the eccentricity in rotation of the latter mandrel. At the same time, any off-center motion of the taper plug or wire brush is prevented in forcibly bending the ribs down into pemanent contact with the adjacent ribs in succession.

We claim:

1. Apparatus for manufacturing a heat transfer tube comprising means for conveying a material tube longitudinally, a first mandrel for forming alternate ribs and grooves on the inside of said tube, a second mandrel for forming cuts into said ribs and forcibly bending and joining said ribs successively to the adjacent ones, and a die, said first mandrel having grooves and ridges on the surface for inversely forming said ribs and grooves on the inner wall surface of said tube and also having a longitudinally extending bore coaxial with a stem of said first mandrel, said second mandrel including a tool for forming cuts at given intervals in the ribs formed on the inside of said tube by the grooves and ridges of said first mandrel and also including a tool for forcibly bending the crests of said ribs with said cuts sidewise into pemanent contact with intermediate parts of the adjacent ribs successively and thereby joining said ribs altogether, said second mandrel being inserted into said bore of said first mandrel in such a manner that said tools for forming cuts and joining said ribs to the adjacent ones are both exposed from the end of said first mandrel, said die being located in the vicinity of the portion of said first mandrel formed with said grooves and ridges.

2. Apparatus according to claim 1 wherein said grooves and ridges of said first mandrel for inversely forming said ribs and grooves on the inside of said tube are formed straightly in parallel with the axis of said mandrel.

3. Apparatus according to claim 2 wherein said second mandrel for forming cuts in said ribs and joining said ribs to the adjacent ones successively is connected to drive means for rotating said second mandrel.

4. Apparatus according to claim 3 wherein said tool of said second mandrel for forming said cuts in said ribs is at least one cutting blade.

5. Apparatus according to claim 3 wherein said tool of said second mandrel for joining said ribs to the adjacent ones successively is a taper plug.

6. Apparatus according to claim 3 wherein said tool of said second mandrel for joining said ribs to the adjacent ones successively is a wire brush.

7. Apparatus according to claim 1 wherein said grooves and ridges of said first mandrel are formed helically at a given angle to the axis of said mandrel.

8. Apparatus according to claim 7 wherein said second mandrel is connected to drive means for rotating said mandrel.

9. Apparatus according to claim 8 wherein said tool of said second mandrel for forming said cuts in said ribs is at least one cutting blade.

10. Apparatus acccording to claim 8 wherein said tool of said second mandrel for joining said ribs to the adjacent ones successively is a taper plug.

11. Apparatus according to claim 8 wherein said tool of said second mandrel for joining said ribs to the adjacent ones successively is a wire brush.

12. Apparatus according to claim 1 wherein a billet is compressed by a ram and extruded into a tube form through an annular space between said die and said first mandrel for forming alternative ribs and grooves on the inside of said tube, in such a manner that said tube is moved relative to said mandrel.

13. Apparatus according to claim 1 wherein said die is a forming die which cooperates with a ram for compressing a billet and said first mandrel for producing alternate ribs and grooves to form a tube from a billet.

14. Apparatus according to claim 1 wherein said die is one for drawing a pipe material to a reduced outside diameter as desired.

15. Apparatus according to claim 1, wherein said second mandrel is connected to drive means for rotating said mandrel.

16. Apparatus according to claim 2, wherein said second mandrel is connected to drive means for rotating said mandrel.

17. Apparatus according to claim 12, wherein said second mandrel is connected to drive means for rotating said mandrel.

18. Apparatus according to claim 13, wherein said second mandrel is connected to drive means for rotating said mandrel.

19. Apparatus according to claim 14, wherein said second mandrel is connected to drive means for rotating said mandrel.

* * * * *